US011331820B2

(12) United States Patent
Petrelli et al.

(10) Patent No.: US 11,331,820 B2
(45) Date of Patent: May 17, 2022

(54) MOTION TRANSMISSION UNIT, DRIVE TRAIN AND HAIR CUTTING APPLIANCE

(71) Applicant: KONINKLIJKE PHILIPS N.V., Eindhoven (NL)

(72) Inventors: Marcus Cornelis Petrelli, Groningen (NL); Alwin William De Vries, Zuidlaren (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 164 days.

(21) Appl. No.: 16/628,698

(22) PCT Filed: Jul. 2, 2018

(86) PCT No.: PCT/EP2018/067725
§ 371 (c)(1),
(2) Date: Jan. 6, 2020

(87) PCT Pub. No.: WO2019/007864
PCT Pub. Date: Jan. 10, 2019

(65) Prior Publication Data

US 2020/0180175 A1 Jun. 11, 2020

(30) Foreign Application Priority Data

Jul. 7, 2017 (EP) ..... 17180303.4

(51) Int. Cl.
*B26B 19/28* (2006.01)
*B26B 19/06* (2006.01)
*B26B 19/38* (2006.01)

(52) U.S. Cl.
CPC ..... *B26B 19/28* (2013.01); *B26B 19/063* (2013.01); *B26B 19/3846* (2013.01); *B26B 19/3853* (2013.01)

(58) Field of Classification Search
None
See application file for complete search history.

(56) References Cited

U.S. PATENT DOCUMENTS 4,428,117 A * 1/1984 Horii ..... B26B 19/04 30/43.7
4,642,892 A 2/1987 Ishida
(Continued)

FOREIGN PATENT DOCUMENTS

DE 34 30 562 C1 * 11/1985
EP 0 151 971 A2 * 1/1985
(Continued)

OTHER PUBLICATIONS

International Search Report and Written Opinion dated Sep. 27, 2018 for International Application No. PCT/EP2018/067725 Filed Jul. 2, 2018.
(Continued)

*Primary Examiner* — Hwei-Siu C Payer

(57) ABSTRACT

A motion transmission unit for a drive train of a hair cutting appliance includes an input shaft, an eccentric portion, a motion converter, and a tilting lever that engages a driving portion of a blade set. The motion converter is arranged between the input shaft and the tilting lever. The eccentric portion engages a motion converter input interface. A motion converter output interface engages the tilting lever input interface and includes a cylindrical portion defining a cylinder axis parallel to a swivel axis of the tilting lever. A tilting lever output interface includes a head portion defining a cylinder axis parallel to a swivel axis of the tilting lever. The cylinder axis of the head portion and the cylinder axis of the cylindrical portion are parallel to the swivel axis.

20 Claims, 6 Drawing Sheets

(56) References Cited

U.S. PATENT DOCUMENTS

| | | | | | |
|---|---|---|---|---|---|
| 4,660,283 | A * | 4/1987 | Yasunaka | B26B 19/04 | 30/43.92 |
| 4,845,847 | A * | 7/1989 | Yasunaka | B26B 19/102 | 30/34.1 |
| 5,193,275 | A * | 3/1993 | Hirokazu | B26B 19/04 | 30/43 |
| 5,259,116 | A | 11/1993 | Laube | | |
| 5,325,590 | A * | 7/1994 | Andis | B26B 19/28 | 30/216 |
| 5,678,312 | A | 10/1997 | Watanabe | | |
| 5,679,991 | A * | 10/1997 | Wolf | B26B 19/04 | 310/37 |
| 8,418,369 | B1 | 4/2013 | Laube | | |
| 8,769,824 | B2 * | 7/2014 | Heerlein | B26B 19/24 | 30/43.92 |
| 9,346,179 | B2 * | 5/2016 | Ziegler | B26B 19/28 | |
| 2005/0060893 | A1 * | 3/2005 | Comminges | B26B 19/24 | 30/216 |
| 2006/0107530 | A1 | 5/2006 | Shimizu | | |
| 2011/0119930 | A1 * | 5/2011 | Scheunert | B26B 19/06 | 30/228 |
| 2017/0190063 | A1 | 7/2017 | Schratter | | |
| 2018/0085950 | A1 * | 3/2018 | Fischer | B26B 19/3866 | |
| 2020/0180175 | A1 * | 6/2020 | Petrelli | B26B 19/28 | |

FOREIGN PATENT DOCUMENTS

| | | |
|---|---|---|
| EP | 2123408 | 11/2009 |
| EP | 2776217 | 9/2014 |
| GB | 2378407 | 2/2003 |
| KR | 20110005643 | 1/2011 |
| WO | 2015/158681 | 10/2015 |

OTHER PUBLICATIONS

International Preliminary Report on Patentability dated May 17, 2019 for International Application No. PCT/EP2018/067725 Filed Jul. 2, 2018.

* cited by examiner

MOTION TRANSMISSION UNIT, DRIVE TRAIN AND HAIR CUTTING APPLIANCE

CROSS REFERENCE TO RELATED APPLICATIONS

This application is the U.S. National Phase application under 35 U.S.C. § 371 of International Application No. PCT/EP2018/067725 filed Jul. 2, 2018, published as WO 2019/007864 on Jan. 10, 2019, which claims the benefit of European Patent Application Number 17180303.4 filed Jul. 7, 2017. These applications are hereby incorporated by reference herein.

FIELD OF THE INVENTION

The present disclosure relates to a motion transmission unit for a drive train of a hair cutting appliance and to a hair cutting appliance that is equipped with a respective motion transmission unit. More particularly, the present disclosure relates to motion transmission units that are capable of transmitting a driving motion for a blade set of a hair cutting appliance, wherein a certain inclination is present between a main orientation of an input shaft and (a normal of) a cutter blade (movable blade) of the blade set that is to be driven by the motion transmission unit. More particularly, but not to be understood in a limiting sense, the present disclosure relates to improvements in drive trains for hair cutting appliances having somewhat curved or banana-shaped casings, for ergonomic reasons, for product design reasons, and/or for reachability/visibility reasons, for instance.

Furthermore, more generally, the present disclosure also relates to drive trains for hair cutting appliances that are arranged to convert a rotational input movement into a reciprocating (oscillating) output movement, preferably a basically linear reciprocating output movement.

BACKGROUND OF THE INVENTION

EP 2 123 408 A1 discloses a hair clipper having a cutting plane formed at an angle of from 10 to 70 degrees with the longitudinal axis of the gripping piece. The drive train of this device is disclosed to comprise a sliding block constructed in the form of a cylinder extending in a direction that is vertical with respect to the drive shaft.

US 2006/0107530 A1 discloses a reciprocating-type electric shaver comprising an outer cutter and an inner cutter that makes a reciprocating motion while making sliding contact with an inside surface of outer cutter, the shaver further comprising an oscillator which is driven in a reciprocating motion by a motor installed inside a main body of said shaver; a central shaft which is provided in an upright position on said oscillator and extends towards an inside of said outer cutter; an inner cutter holder which is slidably disposed on said central shaft so that said inner cutter holder holds said inner cutter thereon and said inner cutter swings about a straight line that is perpendicular to a reciprocating direction of said inner cutter; and a spring which is provided between said oscillator and said inner cutter holder.

WO 2015/158681 A1 discloses a coupling linkage for a drive train of a hair cutting appliance comprising a driving shaft and a non-aligning output shaft, said coupling linkage comprising a first driving coupling element arranged to be driven by a driving shaft, particularly by a motor shaft, a transmission shaft, particularly a rigid transmission shaft, comprising a first driveable coupling element at a first end and a second driving coupling element at a second end thereof, wherein the first driving coupling element engages the first driveable coupling element for rotatingly driving the transmission shaft, thereby forming a first pivoting joint, and wherein the second driving coupling element is arranged to engage a second driveable coupling element of an output shaft.

In accordance with the arrangement described in WO 2015/158681 A1, a drive train for a hair cutting appliance is provided which is suitable for curved or banana-shaped casings and housings. Consequently, an easy-to-handle appliance may be provided which facilitates operating the appliance which may be beneficial in shaving applications and trimming applications.

As shown in documents US 2006/0107530 A1 and WO 2015/158681 A1, a drive train mechanism for a hair cutting appliance that is arranged to convert a rotating input movement into a reciprocating output movement for a linear reciprocating relative movement between a cutter blade (movable blade) and a guard blade (stationary blade) typically involves an eccentric portion at a rotating input drive shaft, wherein the eccentric portion revolves about a longitudinal axis of the drive shaft. The revolving movement of the eccentric portion is transferred via a tilting lever into a reciprocating swiveling movement which is then converted into a basically linear reciprocating movement between the two blades of the blade set.

From a motion conversion point of view, it would be best to arrange the blade set in such an orientation that elements of the drive train may be basically aligned and/or oriented in a fashion basically parallel to one another. In this way, angular offsets between coupled elements of the drive train may be omitted.

However, in practice, often a certain inclination angle between a main orientation of the blade set and a drive unit (i.e. driving motor and respective output shaft) of the hair cutting appliance is present. As a further constraint, often the appliance's housing is not only elongated but also at least slightly curved or banana-shaped.

Hence, there are often design constraints that result in a certain angular offset between an input shaft and an output (normal of blade set movement plane) of the motion transmission unit.

It has been observed that, in terms of kinematics, connecting elements that are offset from one another by a considerable angle and, at the same time, arranged to convert a rotating input movement into a reciprocating output movement may cause, as a side effect, undesired forces and/or torques on involved elements. This may increase undesired friction, wear, heat generation, power consumption, etc. and reduce the durability of the device and the operating performance.

To cope with these design constraints, one option would be to provide the drive train and particularly the motion transmission unit with certain clearances and/or a certain deformability. In this way, excessive loads can be avoided. However, a drawback of this approach is that the drive train of the hair cutting appliance has a somewhat soft character. From a cutting performance's perspective, a stiff and rigid appearance of the drive train and the involved motion transmission unit is preferred.

SUMMARY OF THE INVENTION

It is an object of the present disclosure to provide a motion transmission unit for a drive train of a hair cutting appliance that improves the overall cutting performance of the appliance and that preferably reduces internal stress and loads that is associated with the kinematic design of the drive train. More preferably, the motion transmission unit involves a conversion stage that converts a rotational driving input motion into a reciprocating (linear or nearly linear) output movement.

More preferably, the motion transmission unit enables a smooth running of the drive train, and therefore achieves a reduced noise level, and improvements in power consumption and lifetime.

In a first aspect of the present disclosure there is presented a motion transmission unit for a drive train of a hair cutting appliance, the unit comprising:

an input shaft defining a longitudinal axis and comprising an eccentric portion that is arranged to revolve about the longitudinal axis when the input shaft is rotated, a motion converter comprising a motion converter input interface and a motion converter output interface, and a tilting lever that is pivotably mounted and comprises a tilting lever input interface and a tilting lever output interface that engages a driving portion of a blade set of the appliance, wherein the motion converter is arranged between the input shaft and the tilting lever, wherein the eccentric portion of the input shaft engages the motion converter input interface, wherein the motion converter output interface engages the tilting lever input interface, wherein the motion converter input interface and the motion converter output interface are arranged at the same longitudinal level with respect to the input shaft.

wherein the motion converter output interface comprises a cylindrical portion defining a cylinder axis that is basically parallel to a swivel axis of the tilting lever, wherein the driving portion of the blade set is arranged as a slot that is engaged by the tilting lever output interface; and wherein the cylinder axis of the head portion of the tilting lever and the cylinder axis of the cylindrical portion of the motion converter are basically parallel to the swivel axis.

Hence, the main orientation of the cylindrical portion at the motion converter is somewhat inclined with respect to the main orientation of the revolving eccentric pin that engages the input interface of the motion converter.

This aspect is based on the insight that a reduction of the longitudinal offset between the input interface and the output interface of the motion converter has a positive benefit on the kinematic conditions of the motion transmission unit.

As a result, it is possible to form the motion transmission unit in such a way that primarily line contacts between involved moveable elements are present. This applies in particular to slide contacts of the motion transmission unit. Hence, a reduced distributed load may be achieved. Further, reduced wear, increased lifetime and smooth running conditions may be achieved.

As a further potential benefit, contact points of both the input shaft and the tilting lever with the motion converter are basically at the same level. This has the effect that there is in practice no considerable (longitudinal) lever by means of which a potentially disturbing torque could be generated.

Hence, little to no parasitic torque is produced in the motion converter. Consequently, adverse kinematic effects may be significantly reduced or even avoided. For instance, at the motion converter, preferably only a linear force inducing a basically reciprocating linear movement is generated. By contrast, if a certain (longitudinal) lever would be present between the input interface and the output interface of the motion converter, disturbing torque would be inherently generated when the drive train is operated to drive the blade set of the appliance. Hence, since the level of parasitic forces and torques is greatly reduced, dynamic loads on involved components may be greatly reduced which has a positive effect on the overall performance of the drive train and the hair cutting appliance.

More generally, and basically regardless of a given position and orientation of the involved elements of the drive train of the hair cutting appliance, it is possible in accordance with main aspects of the present disclosure to design the motion transmission unit in such a way that improved contact conditions are present, particularly at the interfaces of the motion converter and the tilting lever. Hence, freedom of design is greatly improved. Further, potentially disturbing moments and torques that are generally not easy to be borne by the elements of the motion transmission unit may be greatly reduced or even avoided, due to the kinematic design of the motion transmission unit.

As used herein, the term longitudinal level relates to a certain position at the longitudinal axis. Hence, the contact points (working points) of the engagement of both the motion converter input interface with the input shaft and the motion converter output interface with the tilting lever are arranged at virtually the same point at the longitudinal axis of the input shaft.

Further, it is to be noted that the above also includes arrangements wherein the input interface and the output interface of the motion converter are basically on the same longitudinal level. Also with these embodiments, considerable improvements may be achieved.

The motion converter in accordance with the above aspect is disposed between the input shaft and the tilting lever, in terms of motion transmission. Hence, the input shaft engages the motion converter input interface. Further, the motion converter output interface engages the tilting lever.

The input shaft may also be referred to as output shaft or driving shaft. Hence, the input shaft may be formed by an output shaft of a motor of the drive train. In some cases, gears may be interposed between the motor output shaft and the input shaft of the motion transmission unit.

Generally, the above arrangement may be implemented in a hair cutting appliance having an input shaft that is non-aligned with respect to a driving portion of a movable blade (cutter blade) of the blade set. As used herein, the term non-aligned may relate to a certain angle between a movement plane (cutting plane) jointly defined by the stationary blade and the movable blade of the blade set and the longitudinal axis of the input shaft. Offset angles therebetween may be in a range of between greater than 0° (degrees) and smaller than 90°. More particularly, an overall offset angle between the blade set and the input shaft may be in the range of between 30° and 60°, for instance.

In spite of the above definition, the motion transmission unit in accordance with the above aspect may also be implemented in a hair cutting appliance wherein the offset angle between the movement plane of the blade set and the longitudinal axis of the input shaft is 0° (i.e. parallel) or 90° (i.e. perpendicular). However, more generally, basically any angle between the movement plane of the blade set and the longitudinal axis of the input shaft may be accommodated by the motion transmission unit.

Generally, at least in major embodiments, the motion transmission unit is arranged to induce a linear or basically linear reciprocating movement between the movable blade and the stationary blade of the blade set. The movement direction of this reciprocating movement is basically perpendicular with respect to the longitudinal axis of the input shaft which, however, shall not be interpreted in a limiting sense.

To provide the desired line contact conditions, it is preferred to arrange the cylinder axis exactly parallel with respect to the swivel axis of the tilting lever. This may involve that the cylinder axis and the swivel axis are arranged at a certain angle with respect to the longitudinal axis, particularly at an angle of greater than 0° and less than 90°, preferably in a range of between 30° and 60°.

The eccentric portion is an eccentric pin, wherein the motion converter input interface is a guide slot that is engaged by the eccentric pin. The eccentric pin is arranged at a frontal end of the input shaft at a distance from the longitudinal axis thereof. Hence, when the input shaft is rotated, the eccentric pin revolves about the longitudinal axis. The guide slot at the motion converter is adapted to the position and the size of the eccentric pin.

In a further exemplary embodiment of the motion transmission unit, the motion converter is arranged to convert the revolving movement of the eccentric portion of the input shaft into an oscillation, particularly a linear oscillation, having a primary movement direction that is perpendicular to the longitudinal axis of the input shaft. Hence, the motion converter already converts the rotating input movement into a reciprocating output movement at the output interface thereof.

In a further exemplary embodiment of the motion transmission, in the cylindrical portion a radially extending recess is provided that forms a guide slot that is arranged to be engaged by the eccentric portion of the input shaft. In other words, the guide slot that is arranged to be engaged by the eccentric pin extends into and may extend through the cylindrical portion. This has the effect that contact points (or line contact/surface contact spots) between the eccentric pin and the motion converter input interface, and between the tilting lever and the motion converter output interface are basically on the same longitudinal level.

In other words, more generally, the motion converter input interface is arranged as a guide slot or recess in the motion converter output interface.

In yet another exemplary embodiment of the motion transmission unit, the tilting lever input interface is arranged as a yoke that laterally embraces the motion converter output interface. The yoke comprises two basically parallel sides that contact the cylindrical portion of the motion converter.

It is to be noted in this context that in alternative embodiments the yoke is provided at the motion converter, whereas the cylindrical portion is provided at the tilting lever. In either alternative, the contact points between the input shaft, the motion converter and the tilting lever are on the same longitudinal level or basically on the same longitudinal level with respect to the input shaft longitudinal axis.

In still another exemplary embodiment of the motion transmission unit, the tilting lever is pivoted in a swivel plane that is basically perpendicular to a swivel axis thereof. The swivel plane is defined by the pivoting movement of the tilting lever. The tilting lever has a main extension direction that is basically parallel to or aligned with the swivel plane. The swivel plane may be regarded as a plane that divides the overall inclination angle between the blade set and the longitudinal axis of the input shaft into two angular portions.

A first angular portion is defined by the movement plane of the blade set and the swivel plane of the tilting lever. A second angular portion is defined by the longitudinal axis of the input shaft and the swivel plane of the tilting lever. In this way, a considerably large angular offset between the blade set and the input shaft of the motion transmission unit may be divided into two segments that are more easy to cope with, in terms of kinematics.

In still another exemplary embodiment of the motion transmission unit, the swivel plane of the tilting lever is inclined with respect to the longitudinal axis of the input shaft. An angle of inclination may be in the range of greater than 0° to less than 90°, preferably in the range of between 15° to 75°, more preferably in the range of between 30° to 60°.

In yet another exemplary embodiment of the motion transmission unit, the tilting lever is mounted to a swivel bearing that is arranged in a central portion of the tilting lever. Hence, the tilting lever may be arranged similar to a rocker, wherein the input interface is arranged at a first end and the output interface is arranged at a second end. Preferably, engagement elements at the input interface and the output interface of the tilting lever are aligned with the swivel axis thereof, so that a connecting line therebetween crosses the swivel axis.

An in-line arrangement may have the advantage that in operation primarily bending torques (about the swivel bearing) rather than torsional forces are acting on the tilting lever. A stiff design of the tilting lever to adequately accommodate and resist the bending torques is basically easy to implement.

In yet another exemplary embodiment of the motion transmission unit, the tilting lever output interface is arranged as a cylindrical portion defining a cylinder axis that is basically parallel to a swivel axis of the tilting lever.

In alternative embodiments, the elements that form the driving portion of the blade set and the tilting lever output interface may be exchanged. Hence, at the tilting lever a slot may be provided, whereas at the driving portion of the blade set, a cylindrical portion may be formed.

In a further exemplary embodiment of the motion transmission unit, the tilting lever is inclined with respect to a movement plane of the blade set. The angle of inclination of the tilting lever is defined by the swivel plane of the tilting lever. An angle of inclination between the tilting lever and the movement plane of the blade set may be between greater than 0° and less than 90°, preferably in a range of 15° to 75°, more preferably in a range of 30° to 60°.

In yet a further exemplary embodiment of the motion transmission unit, a driving point of the motion converter and a driving point of the tilting lever are virtually in the same plane. Again, this prevents potentially adverse parasitic torques in the motion transmission unit. The term driving point may also be referred to as contact point, engagement point (including a point contact, a line contact, and a surface contact).

In still another exemplary embodiment of the motion transmission unit, the motion converter is arranged to be resiliently mounted and laterally coupled to a housing of the appliance. In other words, the motion converter is fixedly attached to the housing, whereas the motion converter comprises deformable portions that are sufficiently flexible to enable the reciprocating movement of the input interface and the output interface thereof.

The motion converter may be arranged as an integrally formed part that is preferably formed in one piece. The motion converter may involve flexible portions that may on the one hand enable a certain movement and that may on the other hand provide a certain rebound force. Hence, the motion converter may provide both an elastic force and a certain damping effect, due to internal friction.

In still another aspect of the present disclosure, there is presented a hair cutting appliance, particularly an electrically operable hair cutting appliance, the hair cutting appliance comprising a housing, a cutting head attached to said housing, and a drive train comprising a motion transmission unit in accordance with at least one embodiment as disclosed herein, wherein the cutting head comprises a blade set, wherein the drive train is arranged to actuate the blade set when the cutting head is attached to the housing, and wherein an total angular offset between a movement plane of the blade set and a longitudinal axis of the input shaft of the motion transmission unit is split into (an aggregate formed by) a first offset angle between the longitudinal axis of the input shaft and a swivel plane of the tilting lever, and by a second offset angle between the swivel plane of the tilting lever and the movement plane of the blade set.

BRIEF DESCRIPTION OF THE DRAWINGS

These and other aspects of the disclosure will be apparent from and elucidated with reference to the embodiments described hereinafter. In the following drawings

DETAILED DESCRIPTION OF THE EMBODIMENTS

Figure 1:
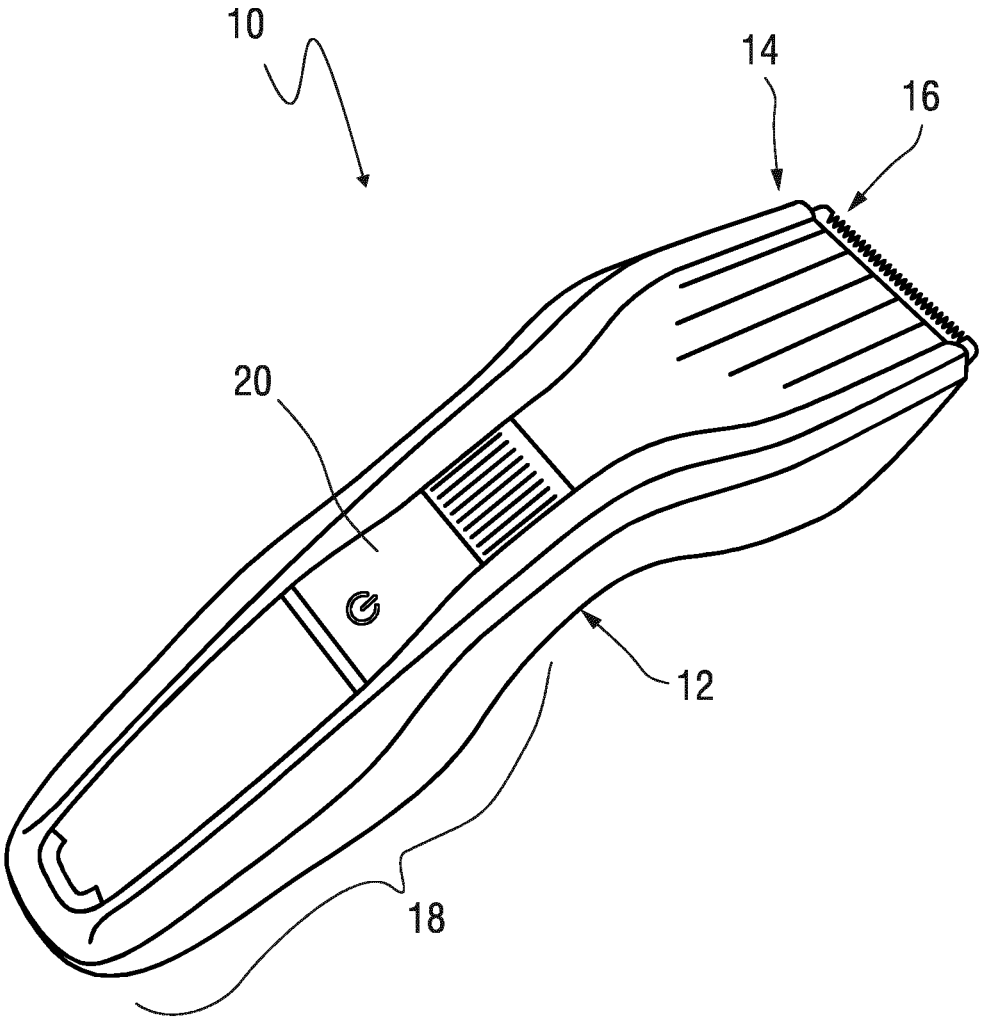
FIG. 1 shows a schematic perspective view of an exemplary embodiment of an electric hair cutting appliance.

FIG. 1 shows a perspective view of a hair cutting appliance 10. The appliance 10 comprises a housing 12. Further, a cutting head 14 is provided that is disposed at or attached to the housing 12. At the cutting head 14, a blade set 16 is formed that involves a stationary blade and a cutter blade that are arranged to be moved with respect to one another to cut hair.

At a side of the housing 12 that is facing away from the cutting head 14, a handle portion 18 is provided. Further, indicated by reference numeral 20, controls are formed at the housing 12.

As can be seen from FIG. 1, the housing 12 has a generally elongated and somewhat curved shape. A user may grasp the appliance 10 in the handle portion 18 and guide the appliance 10 accordingly to cut hair with the blade set 16.

There are several design constraints and design goals for hair cutting appliances 10. For instance, a design of the housing 12 basically shall conform with industrial design goals, ergonomic design goals, and shall provide sufficient room to accommodate the required elements of the appliance 10 therein. A further design goal is to have the cutting head 14 preferably slender to improve the reachability and visibility of the blade set 16.

As a result, quite often the blade set 16 is arranged in a certain orientation so that an angular offset with respect to an input shaft of a drive train is provided. Hence, it may be necessary to provide a motion transmission unit to transmit the driving movement and to convert a rotating movement into a reciprocating movement.

In the following, several aspects and embodiments of a motion transmission unit for a hair cutting appliance 10 will be described and discussed in more detail.

Figure 2:
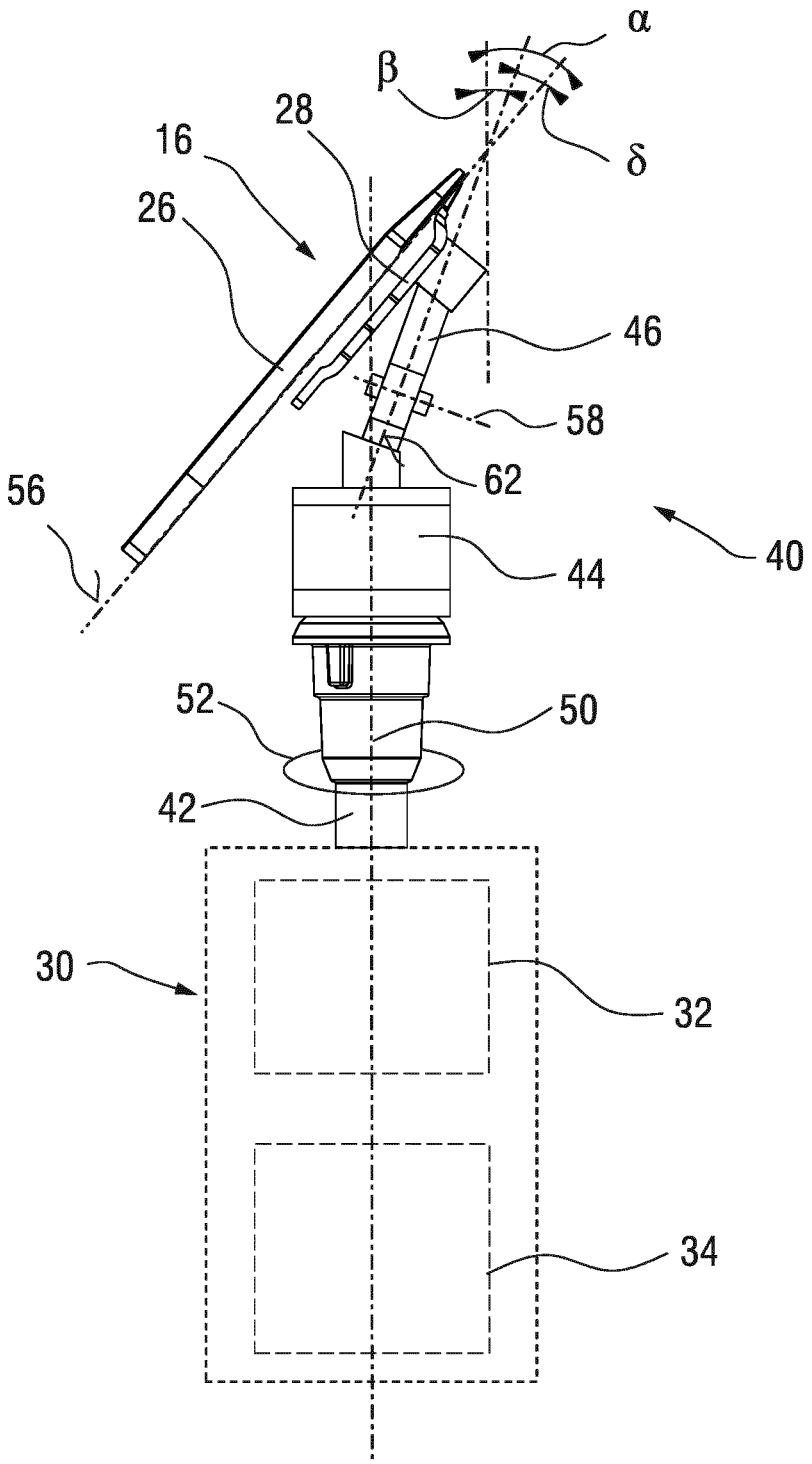
FIG. 2 is a simplified side view of a drive train of a hair cutting appliance.

FIG. 2 is a schematic side view of a drive train 30 for a blade set 16 of a hair cutting appliance 10. The blade set 16 comprises a stationary blade (guard blade) 26 and a cutter blade (movable blade) 28. The drive train 30 involves a motor 32 and, at least in some embodiments, a battery 34. In the alternative or in addition, also a mains contact may be provided. The motor 32 comprises an output shaft that is rotated when the motor 32 is powered. Further, in some embodiments, also gears may be provided to translate the motor's 32 output movement, where necessary.

Further, a motion transmission unit 40 forms part of the drive train 30. The motion transmission unit 40 is designed for two purposes. First, the motion transmission unit 40 is arranged to convert an rotating input movement into a reciprocating output movement on the part of the blade set 16. In addition, the motion transmission unit 40 is arranged to accommodate and manage a certain inclination and/or offset between the blade set 16 and the motor 32 of the drive train 30. That is, between the motor 32 and the blade set 16, a certain longitudinal distance and, at least in some embodiments, a certain angular offset between the motor 32 and a normal of the blade set 16 is present.

The motion transmission unit 40 in accordance with the embodiment illustrated in FIG. 2 comprises an input shaft 42, a motion converter 44, and a tilting lever 46. In this context, additional reference is made to the perspective views of the motion transmission unit 40 shown in FIG. 3 and FIG. 4.

The input shaft 42 is powered by the motor 32 and rotated about a longitudinal axis 50. The rotation of the input shaft 42 is indicated by a curved arrow 52.

Figure 3:
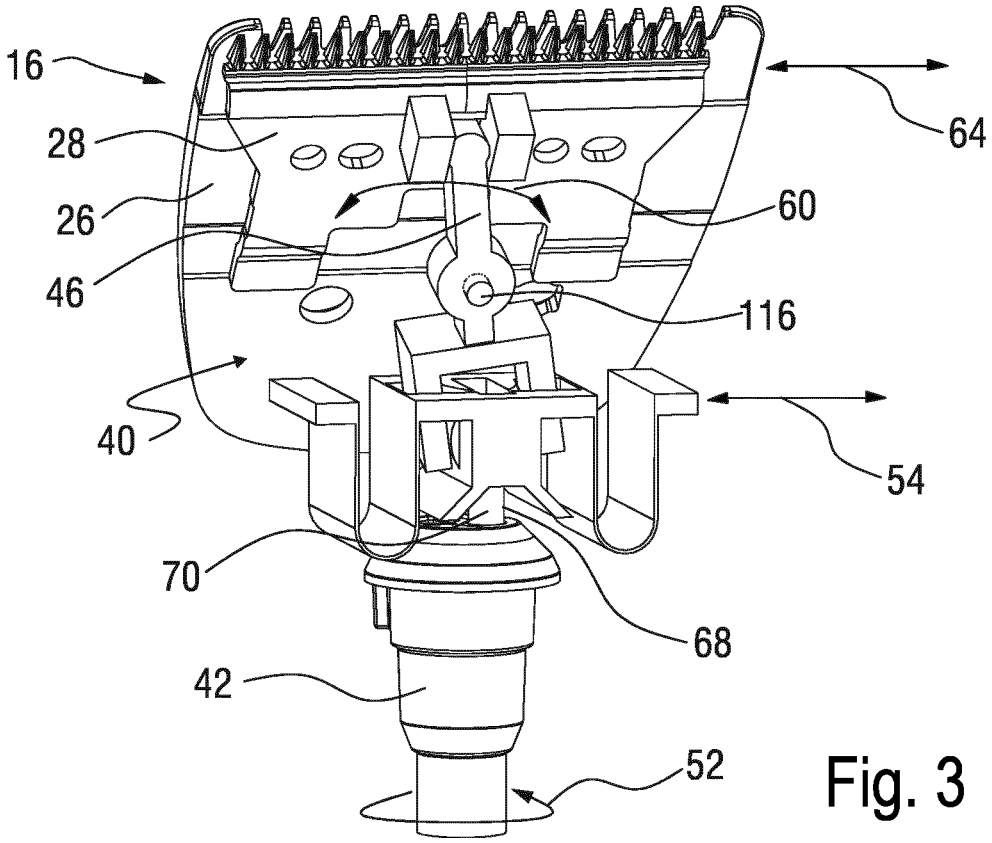
FIG. 3 is a perspective bottom view of an embodiment of a motion transmission unit for a drive train of a hair cutting appliance.
Figure 4:
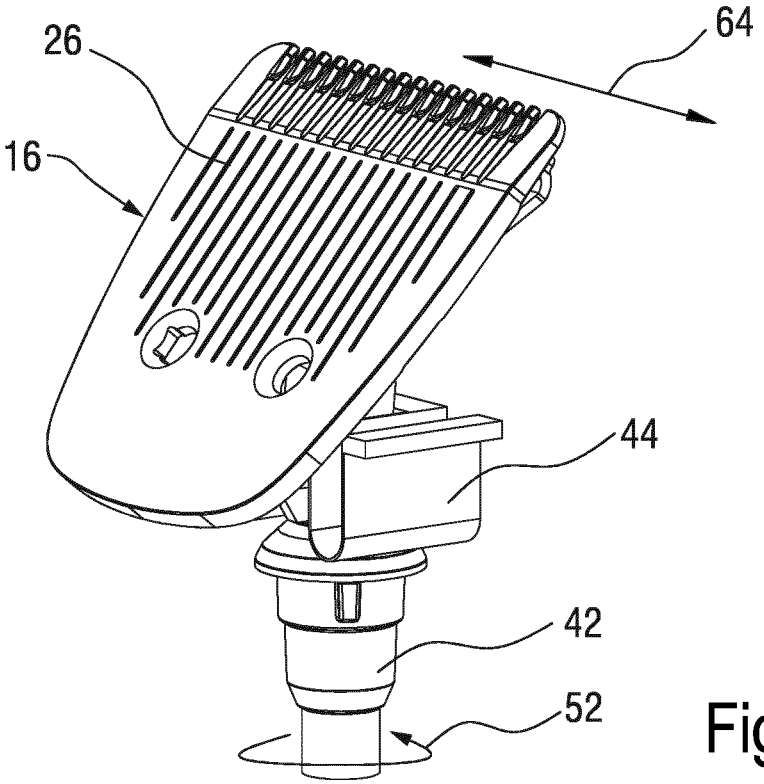
FIG. 4 is a perspective top view of the arrangement of FIG. 3.

The input shaft 42 engages the motion converter 44 in such a way that the motion converter 44 is reciprocatingly actuated when the input shaft 42 is rotated, refer to the double-arrow 54 in FIG. 3.

Hence, due to the engagement of the input shaft 42 and the motion converter 44, the rotating movement of the input shaft 42 is converted into a linear reciprocating movement 54 of the motion converter.

The tilting lever 46 is arranged to be pivoted about a swivel axis 58, refer to FIG. 2. The pivot movement of the tilting lever 46 is indicated by curved double arrow 60 in FIG. 3.

The pivoting action of the tilting lever 46 induces a movement between the cutter blade 28 and the stationary blade 26 of the blade set 16. The stationary blade 26 and the cutter blade 28 jointly define a movement plane 56 at respective contact faces therebetween, refer to FIG. 2.

Between the movement plane 56 and the longitudinal axis 50, an angular offset α (alpha) is present. Generally, the angle α may be in the range between 0° and 90°. Preferably, the angle α is in the range between 15° and 75°, more preferably in the range between 30° and 60°.

The tilting lever 46 is pivoted in a swivel plane 62 that is perpendicular to the swivel axis 58 thereof. The swivel plane 62 may be aligned with a main extension direction of the tilting lever 46. However, the tilting lever 46 may be at least partially curved and/or otherwise shaped in a fashion deviating from the swivel plane 62. Hence, the orientation of the swivel axis 58 defines the overall orientation of the swivel plane 62.

As can be seen in FIG. 2, the orientation of the swivel plane 62 divides the overall angular offset α into two sections, namely an angle η (beta) between the longitudinal axis 50 and the swivel plane 62, and an angle δ (delta) between the swivel plane 62 and the movement plane 56 of the blade set.

It is to be noted that the values for the angles α, β and δ shown in FIG. 2 are primarily provided for illustrative purposes. It will be appreciated by those skilled in the art that the angles α, β and δ may be varied within wide ranges, whereas the sections β and δ jointly form the overall angular offset α.

It is not necessary that the sectional angles β and δ have the same value. Rather, a main benefit of at least some embodiments of the motion transmission unit as discussed herein is that a considerably free choice regarding the orientation of the involved elements of the motion transmission unit 40 is possible so that eventually various design constraints may be adhered to.

Figure 6:
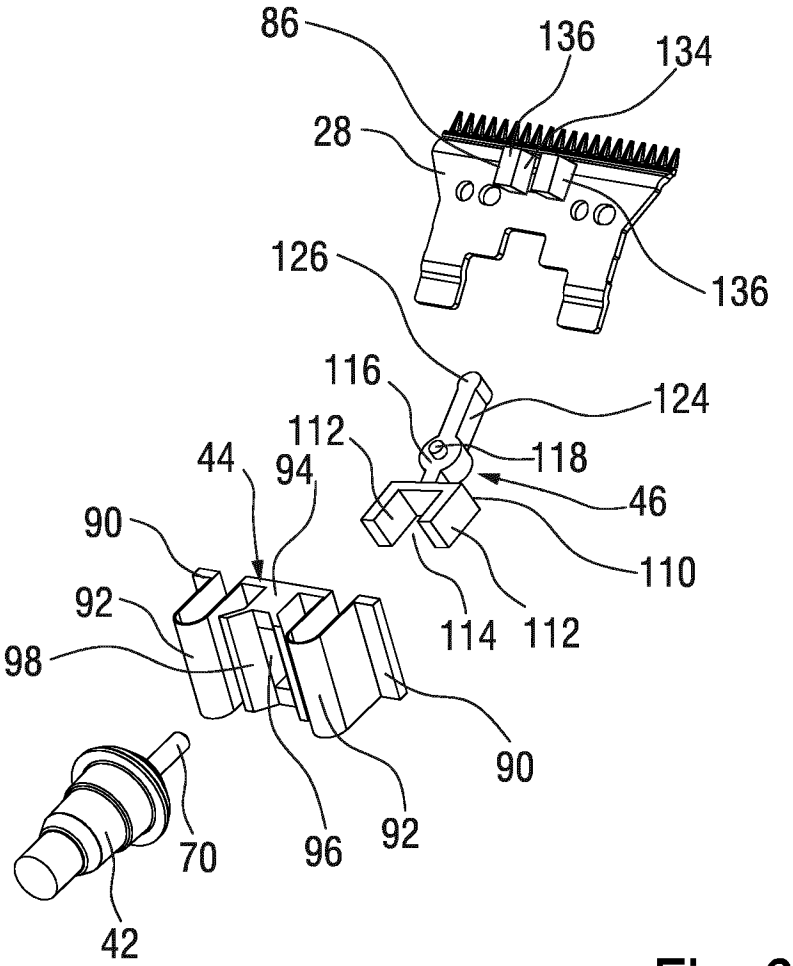
FIG. 6 is a perspective bottom view of the arrangement of FIG. 5.
Figure 5:
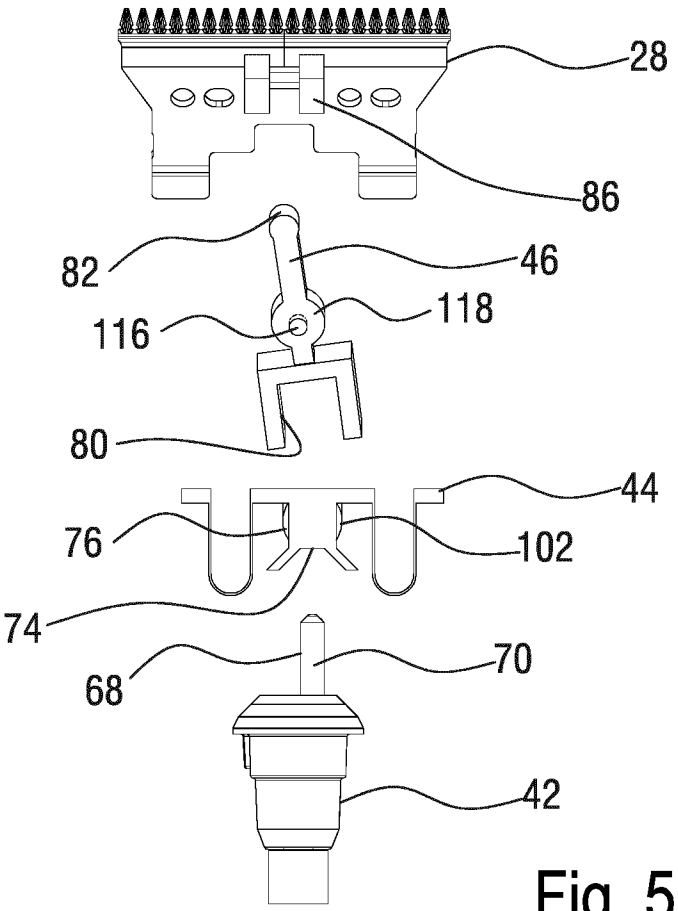
FIG. 5 is an exploded view of the motion transmission unit of FIG. 3, wherein a view level is parallel to a longitudinal axis of an input shaft and parallel to a driving direction of a cutter blade of the blade set.

With reference to FIG. 5 and FIG. 6 and with additional reference to FIG. 7, FIG. 8 and FIG. 9, an exemplary embodiment of the motion transmission unit 40 will be described in more detail.

The input shaft 42 comprises an eccentric portion 68 at a frontal end thereof. The eccentric portion 68 in the embodiment shown in FIGS. 5 and 6 comprises an eccentric pin 70 having a main orientation that is parallel to the main orientation of the input shaft 42. However, the pin 70 is off-center with respect to the longitudinal axis 50. Hence, as the input shaft 42 is rotated, the pin 70 revolves about the longitudinal axis 50.

The eccentric portion 68 of the input shaft 42 engages an input interface 74 of the motion converter. The motion converter 44 further comprises an output interface 76 that engages or is engaged by an input interface 80 of the tilting lever 46. Similarly, also an output interface 82 is present at the tilting lever 46 that engages or is engaged by a driving portion 86 that is formed at the cutter blade 28 of the blade set 16.

The motion converter 44 is, in exemplary embodiments, integrally shaped. Generally, the motion converter 44 may comprise side connectors 90 that are arranged to be attached to a housing portion of the appliance 10. Hence, the side connectors 90 are generally not moved when the motion converter 44 is actuated. Further, the motion converter 44 comprises resilient portions 92 that are arranged as bent portions in the embodiment shown in FIGS. 5 to 9.

Between the resilient portions 92, a central block 94 is formed. When the motion converter 44 is actuated by the eccentric portion 68 of the input shaft 42, the central block 94 is linearly reciprocatingly moved between the side connectors 90 which involves a deformation of the resilient portions 92 that are interposed between the side connectors 90 and the central block 94, respectively.

The resilient portions 92 provide the motion converter 44, on the one hand, with a certain flexibility and, on the other hand, with a certain rebound force. In addition, due to inherent friction, a certain damping feature is provided by the overall arrangement of the motion converter 44.

In the central block 94, a guide slot 96 is provided that forms the input interface 74 of the motion converter. The guide slot 96 is engaged by the pin 70 of the input shaft 42.

Further, inclined walls 98 are formed adjacent to the guide slot 96 at the central block 94 which may serve as an insertion aid for the pin 70.

Basically at the same longitudinal level (with respect to the longitudinal axis 50 of the input shaft 42) where the guide slot 96 is formed, a cylindrical portion 102 is provided at the motion converter 44 that forms the output interface 76 thereof. The cylindrical section 102 may also be referred to as curved section, barrel shaped section, etc. The cylindrical portion 102 defines a cylinder axis 104, refer to FIG. 8 and FIG. 9.

Figure 8:
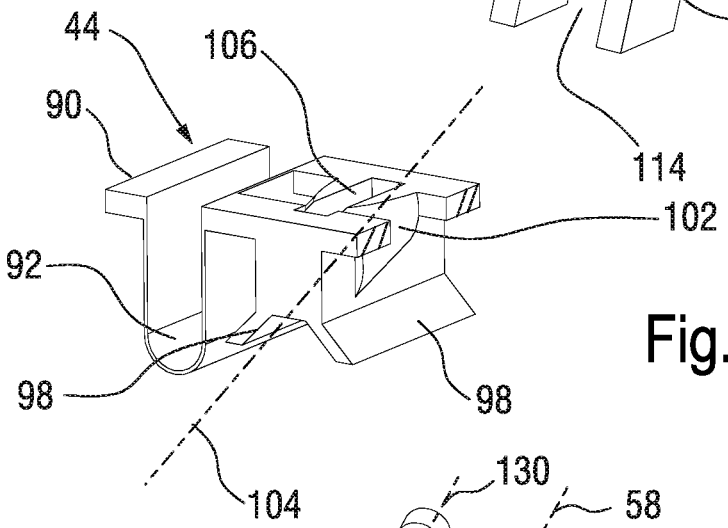
FIG. 8 is a perspective cross-sectional view of an exemplary embodiment of a motion converter for a motion transmission unit.

As can be best seen in FIG. 8, the guide slot 96 may extend through the cylindrical portion 102 and form a top recess 106. FIG. 9 shows a cross section through the cylindrical portion 102 that illustrates that the guide slot 96 extends therethrough as a radially extending recess. It is to be noted that it is not necessary that the guide slot 96 fully extends through the cylindrical portion 102.

The tilting lever 46 is arranged to be pivoted about the swivel axis 58. At a first end thereof, the tilting lever 46 comprises a yoke 110 having side arms 112 that define a guide recess 114 therebetween. The yoke 110 engages or embraces the cylindrical portion 102. In other words, the yoke 110 forms the input interface 80 of the tilting lever 46.

At a central portion 116 thereof, a swivel bearing 118 is formed at the tilting lever 46 which may involve a bearing pin. The swivel bearing 118 eventually defines the swivel axis 58.

Figure 7:
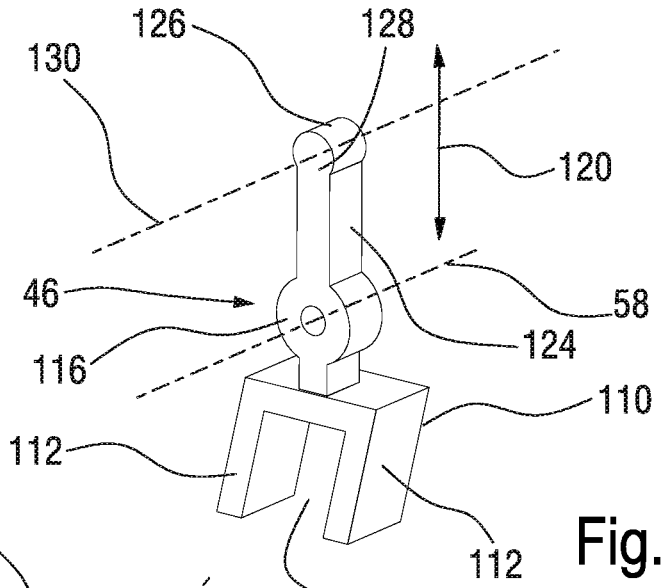
FIG. 7 is a perspective view of an exemplary embodiment of a tilting lever for a motion transmission unit.

A main orientation direction of the tilting lever 46 is indicated by a double arrow 120 in FIG. 7. The main orientation direction 120 is in the embodiment shown in FIG. 7 basically perpendicular to the swivel axis 58. However, it is not in each case necessary to design the tilting lever 46 in such a way that it is perfectly aligned with the main extension direction 120.

The tilting lever 46 further comprises a beam 124 that is basically parallel to and defines the main extension direction 120. The beam 124 extends between a first end and a second end of the tilting lever 46. At an end of the tilting lever 46 that is facing away from the yoke 110, a head portion 126 is formed that is arranged as a cylindrical head portion. The head portion 126 forms the output interface 82 of the tilting lever 46. As shown in FIG. 7, the head portion 126 forms a cylinder section 128 that defines a cylinder axis 130. The cylinder axis 130 is parallel to the swivel axis 58.

Figure 9:
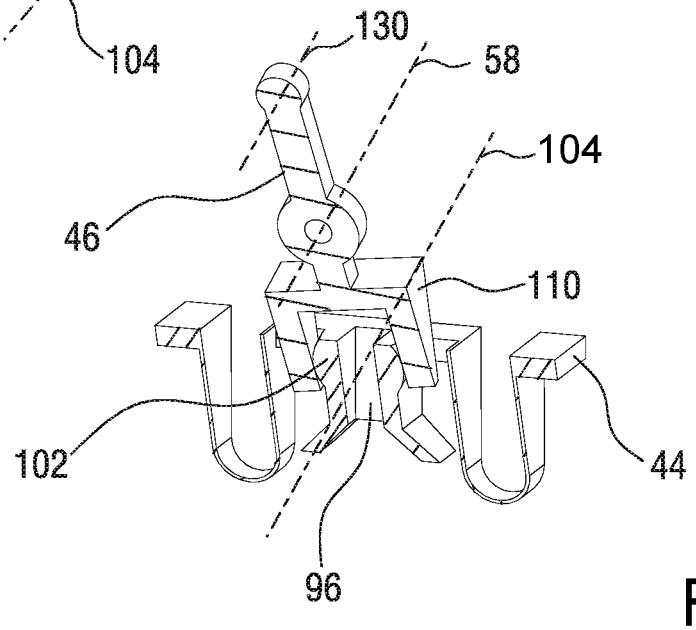
FIG. 9 is a perspective cross-sectional view of the tilting lever of FIG. 7 and the motion converter of FIG. 8 in an engaged state.

In this context, further reference is made to FIG. 9. Preferably, at least in some embodiments, both the cylinder axis 130 of the head portion 126 of the tilting lever 46 and the cylinder axis 104 of the cylindrical portion 102 of the motion converter 44 are basically parallel to the swivel axis 58. This has the effect that a smooth running and little to no parasitic forces and torques is/are present when the motion transmission unit 40 is operated.

Reference is made again to FIG. 6. The output interface 82 of the tilting lever 46 engages the driving portion 86 that is provided at the cutter blade 28. The driving portion 86 is, in the embodiment shown in FIG. 6, formed by two opposite side walls 136 that define a slot 134 therebetween. The cylindrical head portion 126 of the tilting lever 46 engages the slot 134 of the driving portion 86 to effectuate the linear reciprocating movement 64 of the cutter blade 28 with respect to the stationary blade 26.

Figure 10:
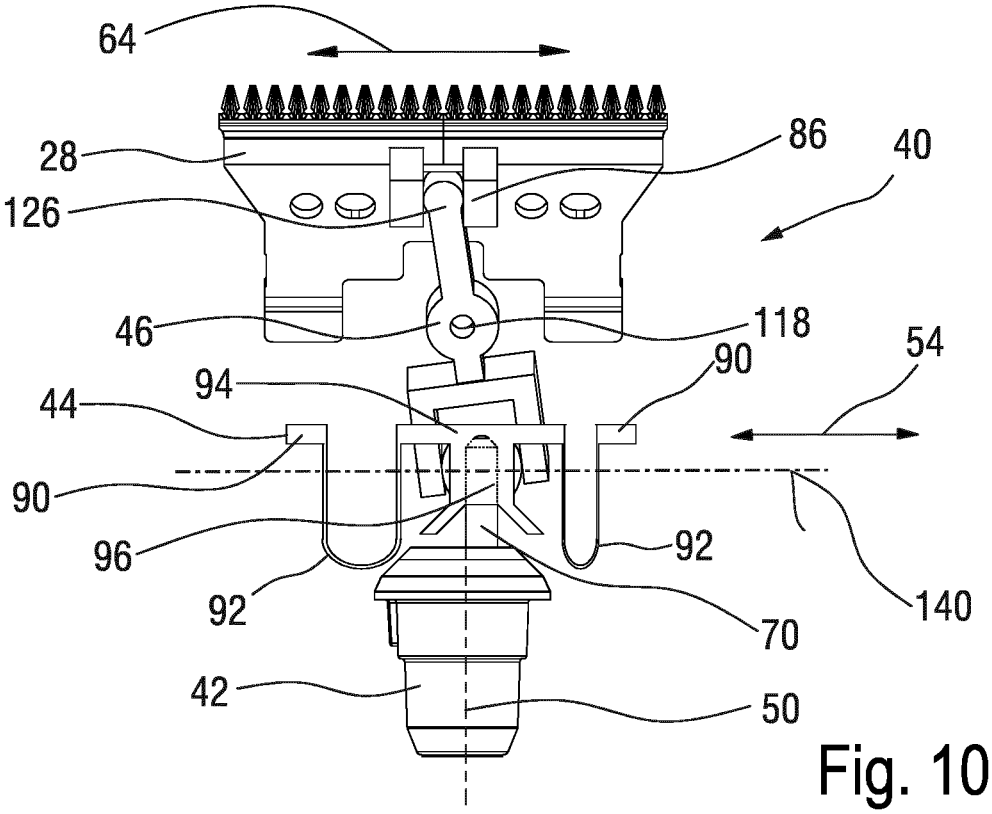
FIG. 10 is a further view of the arrangement of FIG. 5 in an assembled state in a first movement position of the cutter blade.
Figure 11:
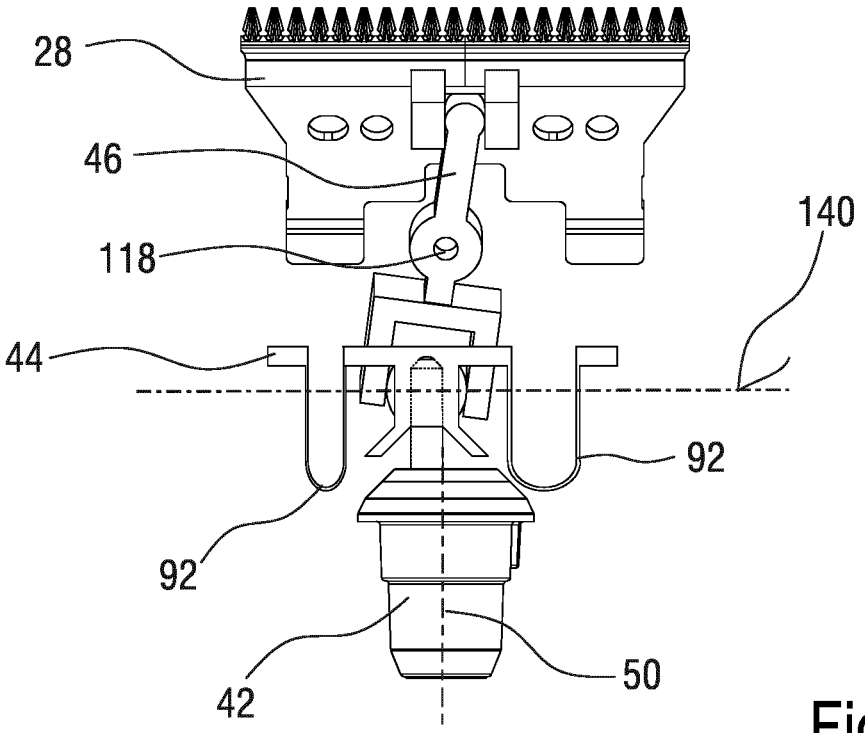
FIG. 11 is a further view of the arrangement of FIG. 10 in a second movement position of the cutter blade.

Additional reference is made to FIG. 10 and FIG. 11, respectively illustrating opposite movement positions (outermost lateral positions) of the cutter blade 28. In FIG. 11, the input shaft 42 is rotated about 180° with respect to the state in FIG. 10.

In FIG. 10, the motion converter 44 central block 94 is moved to a most right position, whereas the cutter blade 28 is moved to a most left position, due to the angular displacement of the tilting lever 46. By contrast, in FIG. 11, the central block 94 of the motion converter 44 is moved to a most left position, whereas the cutter blade 28 is moved to a most right position.

The resilient portions 92 of the motion converter 44 are respectively deformed as the central block 94 is reciprocatingly moved (arrow 54) in reaction to the rotation of the input shaft 42 which causes a revolution of the eccentric pin 70.

In FIG. 10 and FIG. 11, reference numeral 140 indicates the longitudinal level of the contact of both the eccentric portion (pin 70) of the input shaft 42 with the input interface (guide slot 96) of the motion converter 44, and the output interface (cylindrical portion 102) of the motion converter 44 with the input interface (yoke 110) of the tilting lever 46. As a consequence of the levelled arrangement of the respective contact spots, little to no parasitic forces and/or torques are exerted on the motion converter 44 which greatly improves the overall smooth running and performance of the motion transmission unit 40.

Driving or engagement points of the input shaft 42 (pin 70), the motion converter 44 (slot 96 and cylindrical portion 102) and the tilting lever 46 (yoke 110) are arranged in basically the same longitudinal level. It will be appreciated by those skilled in the art that of course there may be slight deviations as for instance the contact points of the yoke 110 are at least slightly moved out of the common longitudinal level 140 when the tilting lever 44 is pivoted. Hence, the common longitudinal level 140 may also be regarded as a (rather narrow) longitudinal range.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A hair cutting appliance, comprising:

a housing, a cutting head attached to said housing, and a drive train including a motion transmission unit, wherein the cutting head comprises a blade set, and wherein the drive train is arranged to actuate the blade set when the cutting head is attached to the housing, wherein the motion transmission unit comprises:

an input shaft defining a longitudinal axis and comprising an eccentric portion that is arranged to revolve about the longitudinal axis when the input shaft is rotated, a motion converter comprising a motion converter input interface and a motion converter output interface, and a tilting lever that is pivotably mounted and comprises a tilting lever input interface and a tilting lever output interface adapted for engaging a driving portion of the blade set, wherein:

a total angular offset between a movement plane of the blade set and the longitudinal axis of the input shaft of the motion transmission unit is split into a first offset angle between the longitudinal axis of the input shaft and a swivel plane of the tilting lever, and a second offset angle between the swivel plane of the tilting lever and the movement plane of the blade set, the motion converter is arranged between the input shaft and the tilting lever, the eccentric portion of the input shaft engages the motion converter input interface, the motion converter output interface engages the tilting lever input interface, and the motion converter input interface and the motion converter output interface are arranged at the same longitudinal level with respect to the input shaft;

the motion converter output interface comprises a cylindrical portion defining a cylinder axis that is basically parallel to a swivel axis of the tilting lever;

the tilting lever output interface is arranged as a cylindrical portion defining a cylinder axis that is basically parallel to the swivel axis of the tilting lever; and the cylinder axis of the cylindrical portion of the tilting lever and the cylinder axis of the cylindrical portion of the motion converter are basically parallel to the swivel axis.

2. A motion transmission unit for a drive train of a hair cutting appliance, the unit comprising:

an input shaft defining a longitudinal axis and comprising an eccentric portion that is arranged to revolve about the longitudinal axis when the input shaft is rotated, a motion converter comprising a motion converter input interface and a motion converter output interface, and a tilting lever that is pivotably mounted and comprises a tilting lever input interface and a tilting lever output interface adapted for engaging a driving portion of a blade set of the appliance, wherein the motion converter is arranged between the input shaft and the tilting lever, wherein the eccentric portion of the input shaft engages the motion converter input interface, wherein the motion converter output interface engages the tilting lever input interface, and wherein the motion converter input interface and the motion converter output interface are arranged at the same longitudinal level with respect to the input shaft;

wherein the motion converter output interface comprises a cylindrical portion defining a cylinder axis that is basically parallel to a swivel axis of the tilting lever;

wherein the tilting lever output interface is arranged as a cylindrical portion defining a cylinder axis that is basically parallel to the swivel axis of the tilting lever;

wherein the cylinder axis of the cylindrical portion of the tilting lever and the cylinder axis of the cylindrical portion of the motion converter are basically parallel to the swivel axis; and wherein a total angular offset between a movement plane of the blade set to be engaged and a longitudinal axis of the input shaft is split into (i) a first offset angle between the longitudinal axis of the input shaft and a swivel plane of the tilting lever, and (ii) a second offset angle between the swivel plane of the tilting lever and the movement plane of the blade set to be engaged.

3. The motion transmission unit as claimed in claim 2, wherein the motion converter is arranged to convert the revolving motion of the eccentric portion of the input shaft into an oscillation having a primary movement direction that is perpendicular to the longitudinal axis of the input shaft.

4. The motion transmission unit as claimed in claim 2, wherein the cylindrical portion of the motion converter output interface is provided with a radially extending recess that forms a guide slot that is arranged to be engaged by an eccentric pin of the eccentric portion of the input shaft.

5. The motion transmission unit as claimed in claim 2, wherein the tilting lever input interface is arranged as a yoke that laterally embraces the motion converter output interface.

6. The motion transmission unit as claimed in claim 2, wherein the tilting lever is pivoted in the swivel plane that is basically perpendicular to the swivel axis thereof.

7. The motion transmission unit as claimed in claim 6, wherein the swivel plane of the tilting lever is inclined with respect to the longitudinal axis of the input shaft.

8. The motion transmission unit as claimed in claim 2, wherein the tilting lever is mounted to a swivel bearing that is arranged in a central portion of the tilting lever.

9. The motion transmission unit as claimed in claim 2, wherein the tilting lever output interface is further adapted for engaging a slot in the driving portion of the blade set.

10. The motion transmission unit as claimed in claim 2, wherein the swivel plane is perpendicular to the swivel axis and adapted for being inclined at the second offset angle with respect to the movement plane of the blade set.

11. The motion transmission unit as claimed in claim 2, wherein a driving point of the motion converter and a driving point of the tilting lever are virtually in the same plane.

12. The motion transmission unit as claimed in claim 2, wherein the motion converter further comprises a central portion formed between resilient portions of the motion converter, further being interposed between side connectors of the motion converter, wherein the motion converter is adapted to be resiliently mounted, via the resilient portions, and adapted for being laterally coupled, via the side connectors, to a housing of the appliance.

13. A motion transmission unit for a drive train of a hair cutting appliance, the unit comprising:

an input shaft defining a longitudinal axis and comprising an eccentric portion that is arranged to revolve about the longitudinal axis when the input shaft is rotated, a motion converter comprising a motion converter input interface and a motion converter output interface, and a tilting lever that is pivotably mounted and comprises a tilting lever input interface and a tilting lever output interface adapted for engaging a driving portion of a blade set of the appliance, wherein the motion converter is arranged between the input shaft and the tilting lever, wherein the eccentric portion of the input shaft engages the motion converter input interface, wherein the motion converter output interface engages the tilting lever input interface, and wherein the motion converter input interface and the motion converter output interface are arranged at the same longitudinal level with respect to the input shaft;

wherein the motion converter output interface comprises a cylindrical portion defining a cylinder axis that is basically parallel to a swivel axis of the tilting lever;

wherein the tilting lever output interface is arranged as a cylindrical portion defining a cylinder axis that is basically parallel to the swivel axis of the tilting lever;

wherein the cylinder axis of the cylindrical portion of the tilting lever and the cylinder axis of the cylindrical portion of the motion converter are basically parallel to the swivel axis; and wherein the motion converter further comprises a central portion formed between resilient portions of the motion converter, further being interposed between side connectors of the motion converter, wherein the motion converter is adapted for being resiliently mounted, via the resilient portions, and adapted for being laterally coupled, via the side connectors, to a housing of the appliance.

14. The motion transmission unit as claimed in claim 13, wherein the motion converter is arranged to convert the revolving motion of the eccentric portion of the input shaft into an oscillation having a primary movement direction that is perpendicular to the longitudinal axis of the input shaft.

15. The motion transmission unit as claimed in claim 13, wherein the cylindrical portion of the motion converter output interface is provided with a radially extending recess that forms a guide slot that is arranged to be engaged by an eccentric pin of the eccentric portion of the input shaft.

16. The motion transmission unit as claimed in claim 13, wherein the tilting lever input interface is arranged as a yoke that laterally embraces the motion converter output interface.

17. The motion transmission unit as claimed in claim 13, wherein the tilting lever is pivoted in a swivel plane that is basically perpendicular to the swivel axis thereof, and wherein the swivel plane of the tilting lever is inclined with respect to the longitudinal axis of the input shaft.

18. The motion transmission unit as claimed in claim 13, wherein the tilting lever is mounted to a swivel bearing that is arranged in a central portion of the tilting lever.

19. The motion transmission unit as claimed in claim 13, wherein the tilting lever further comprises a swivel plane that is perpendicular to the swivel axis of the tilting lever and adapted for being inclined with respect to a movement plane of the blade set, wherein the movement plane is defined by respective contact faces between a stationary blade and a cutter blade of the blade set.

20. The motion transmission unit as claimed in claim 13, wherein a driving point of the motion converter and a driving point of the tilting lever are virtually in the same plane.

* * * * *